US006383449B1

(12) United States Patent
Pennekamp et al.

(10) Patent No.: US 6,383,449 B1
(45) Date of Patent: May 7, 2002

(54) METHOD FOR CONTROLLING AIR SPEED IN A STERILIZING TUNNEL DURING THE HEATING OF SAME TUNNEL

(75) Inventors: Ingbert Pennekamp, Crailsheim; Klaus Hillebrand, Ansbach, both of (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/341,559

(22) PCT Filed: Jan. 14, 1998

(86) PCT No.: PCT/DE98/00106

§ 371 Date: Jul. 14, 1999

§ 102(e) Date: Jul. 14, 1999

(87) PCT Pub. No.: WO98/39216

PCT Pub. Date: Sep. 11, 1998

(30) Foreign Application Priority Data

Mar. 6, 1997 (DE) ..... 197 09 067

(51) Int. Cl.[7] ..... C23F 11/00

(52) U.S. Cl. ..... 422/1; 422/1; 422/28; 422/108; 422/109; 422/110; 422/297; 422/302

(58) Field of Search ..... 422/1, 108, 109, 422/110, 28, 297, 302

(56) References Cited

U.S. PATENT DOCUMENTS 4,192,845 A * 3/1980 Kalasek ..... 422/109
4,729,207 A * 3/1988 Dempsey ..... 236/10
5,472,141 A * 12/1995 Kraemer et al. ..... 126/110

* cited by examiner

*Primary Examiner*—Robert J. Warden, Sr.
*Assistant Examiner*—Imad Soubra
(74) *Attorney, Agent, or Firm*—Ronald E. Greigg

(57) ABSTRACT

In a tunnel-like region of a sterilizing tunnel, containers are advanced by means of a conveyor device. For sterilization, a heated air flow oriented vertically in the region of the containers is used, which is generated by means of a fan and a heater. To prevent particles from being torn out of a sterile filter during the heating phase, there is a provision for adapting the rpm of the fan during the heating phase. According to the invention, this rpm adaptation is done by ascertaining the requisite rotary speeds of the fan beforehand at both room temperature and the sterilization temperature, whereupon a control unit of the sterilizing tunnel, on the basis of a predetermined functional relationship, raises the rpm of the fan as the temperature of the air flow is raised.

10 Claims, 1 Drawing Sheet

METHOD FOR CONTROLLING AIR SPEED IN A STERILIZING TUNNEL DURING THE HEATING OF SAME TUNNEL

PRIOR ART

The invention is based on a method for controlling the air speed in a sterilizing tunnel during its heating phase. Such sterilizing tunnels are used particularly to sterilize ampules, vials or the like in the pharmaceutical packaging industry. Filter elements for cleaning the air recirculated in the sterilizing tunnel are disposed in the sterilizing tunnels. So that the filter elements will on the one hand not be damaged but on the other hand will have their optimal cleaning effect and so that no particles will be torn out of the filter elements, it is necessary that the flow through the filter elements be at a certain air speed.

In a known method of this type, to attain a virtually constant air speed at various temperatures in the sterilizing tunnel during its heating phase, speed measuring instruments are used, which are coupled via a control unit to a fan, whose rpm is varied in accordance with the measured air speed. A disadvantage of this known method is that the air speed measuring instruments, because of the high temperatures attained in the sterilizing tunnel, such as 350° C. at the end of the heating phase, have only a brief dwell time. Furthermore, because of the additional measuring instruments and control units, the known sterilizing tunnels are complicated in design. Measurement errors, for instance from soiling of the measuring devices, also go undetected, so that the sterilization process cannot be carried out reliably. This is because an incorrectly measured air speed also adjusts the rpm of the fan incorrectly, and so the filter elements fail to function optimally.

In another method, it is also known to set the fan rpm as constant, so that at 350° C., for instance, it is 0.5 meters per second. To achieve this, however, an air speed of approximately 0.9 meters per second must be set when the sterilizing tunnel is cold. During the heating process, the initially set elevated air speed automatically decreases, because of the heating of the air, to the air speed required in the sterilization. At the beginning of the heating phase, however, because of the increased air speed and the accordingly large quantity of air, the filter elements disposed in the intake or outlet region of the fan are burdened heavily. Furthermore, the fan must be designed to be strong enough for the large quantity of air. Thus once again, this method entails relatively high effort and equipment expense.

ADVANTAGES OF THE INVENTION

The method of the invention for controlling the air speed in a sterilizing tunnel during its heating phase, has the advantage over the prior art that it works without additional air speed measuring instruments and at the same time is sufficiently precise, and the filter elements always function optimally. It follows from this that the fan or the filters need not be made more powerful, and that the sterilization process will function reliably. According to the invention, this is attained in that the fan rpm is varied in accordance with a predetermined function course.

Further advantages and advantageous refinements of the method of the invention for controlling the air speed in a sterilizing tunnel during its heating phase will become apparent from the claims and the description.

BRIEF DESCRIPTION OF THE DRAWING

One exemplary embodiment of the invention is shown in the drawing and will be described in further detail below.

The sole drawing figure shows a simplified cross section through a sterilizing tunnel.

DESCRIPTION OF THE EXEMPLARY EMBODIMENT

Figure 1:
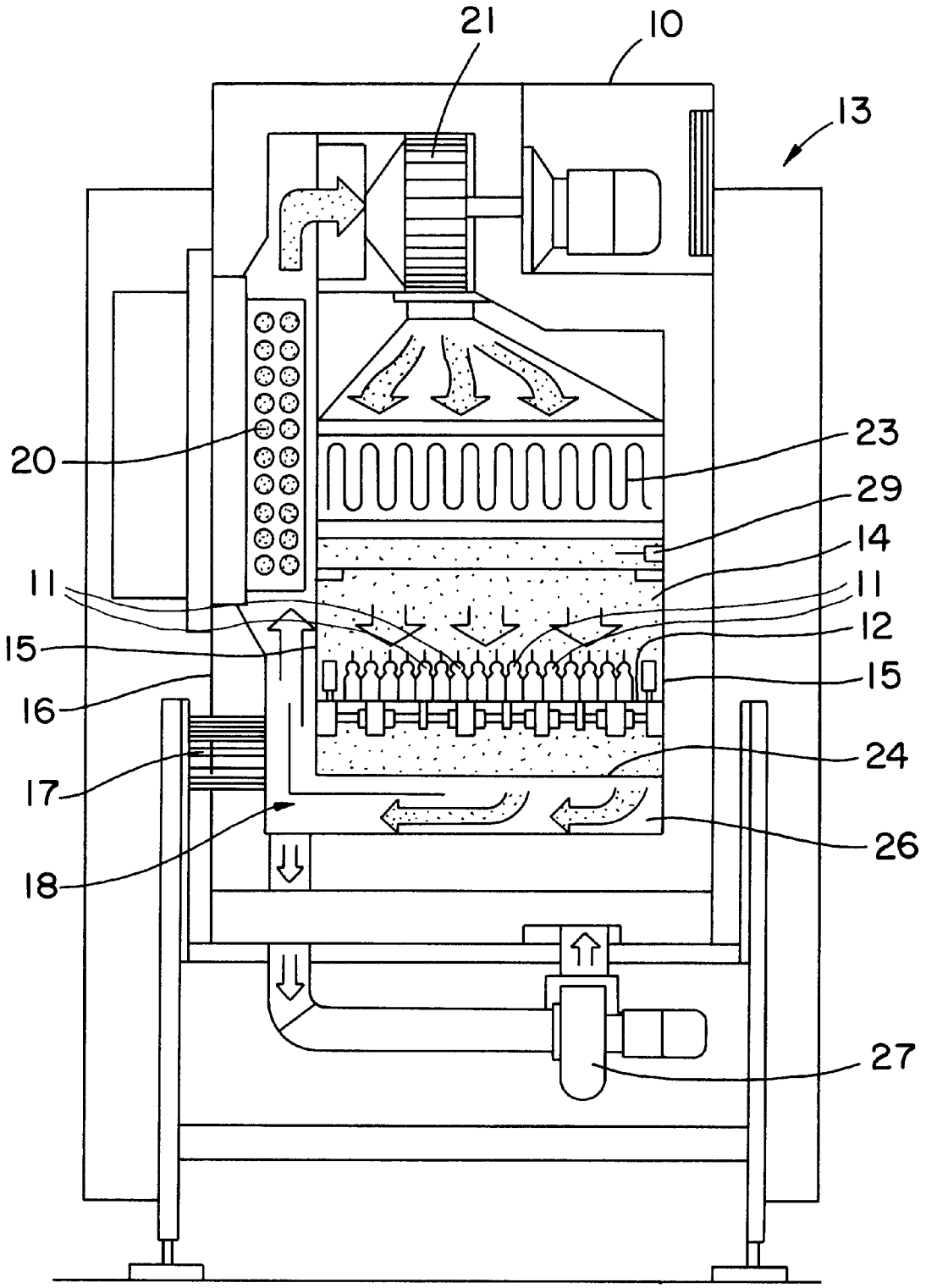

The sterilizing tunnel 10 shown in FIG. 1 is used to handle pharmaceutical containers 11, such as ampules vials or the like, before they are filled. This requires that the containers 11, furnished in nonsterile condition, be sterilized. This is done in the sterilizing tunnel 10 by introducing the containers 11, wet-cleaned beforehand, into the sterilizing tunnel 10, in which, by means of a horizontally revolving, continuously driven conveyor belt 12, the containers are preheated first, in an inlet region not shown, from room temperature to approximately 40° C. Next, the containers 11 pass into the region of the hot area 13 shown in FIG. 1, in which the containers 11 are further heated to approximately 350° C.; germs and the like are killed by the heating and a hot air flow. Finally, the containers 11 are cooled down to room temperature again in a cooling area, also not shown, from which the containers are carried on to a filling system.

In the heating area 13, the sterilizing tunnel 10 has a tunnel-like region 14 with lateral boundary walls 15, in which the containers 11 are disposed, standing upright on the conveyor belt 12. To replenish the hot air flow, an aspirating filter 17 is integrated into an opening in a housing wall 16 of the sterilizing tunnel 10; this filter discharges into a conduit 18 disposed laterally from the region 14 and partitioned off by the one boundary wall 15. A heater 20 is also provided in the conduit 18; the heater heats the aspirated air to the requisite sterilization temperature. From the heater 20, the air passes into a variable-speed fan 21, disposed above the region 14, that aspirates the air and conducts the air, heated in the heater 20, into the region 14 in the form of a hot air flow oriented vertically from top to bottom, via a sterile filter 23 disposed directly above the region 14. Below the conveyor belt 12, which is made of a special steel wire mesh and is thus air-permeable, a grid floor 24 is provided, below which an air exhaust region 26 is disposed. The air exhaust region 26 discharges on the one hand into the conduit 18; on the other, via a second fan 27 in the inlet region of the sterilizing tunnel 10, some of the humid air is removed by suction. To monitor the air temperature in the region 14, a temperature sensor 29 is disposed above the containers 11 in a boundary wall 15; the temperature sensor is connected to the control unit, not shown, of the sterilizing tunnel 10.

The sterilizing tunnel 10 described above functions as follows:

While the sterilizing tunnel 10 is being started up, the air in the region 14 is heated by the heater 20 from room temperature to the requisite sterilization temperature, such as 350° C. In the process, the air is recirculated with the aid of the fan 21. To assure the optimal function of the sterile filter 23 during the sterilization, a flow speed of 0.5 m/s, for example, is needed, which requires a certain fan rpm. However, this fan rpm at room temperature would be equivalent to a flow speed of the air of approximately 0.9 m/s, which is supposed to be avoided to prevent any particles from being torn out of the sterile filter 23. For this reason, according to the invention, the fan rpm is ascertained beforehand; at room temperature, it corresponds to a flow speed of 0.5 m/s as well. This fan rpm, which is known to the control unit of the sterilizing tunnel 10 as an initial or starting value, is below the requisite fan rpm, for the same flow speed of the air, at 350° C. During the heating phase of the sterilizing tunnel 10, the control unit now constantly raises the fan rpm, so that during the heating phase, over the entire temperature range, virtually the same flow speed prevails in the region 14.

In the simplest case, the fan rpm is raised either constantly or in increments over the known or previously ascertained heating time. Preferably, however, the signal supplied to the control unit as an initial value by temperature sensor 29 is used, on the basis of which the control unit raises the rpm, for instance via a linear relationship, as the temperature rises. The relationship between the temperature and the requisite rotary speeds of the fan can, however, also be found on the basis of a more-complex functional relationship stored in memory in the control unit, for instance if flow resistances do not vary linearly with the air temperature.

The foregoing relates to preferred exemplary embodiments of the invention, it being understood that other variants and embodiments thereof are possible within the spirit and scope of the invention, the latter being defined by the appended claims.

We claim:

1. A method for controlling the air speed in a sterilizing tunnel (10) during a heating phase, said sterilizing tunnel (10) having a sterile filter (23) through which air flows, wherein said method comprises raising a rpm of a fan (21) from an initial value, at a first temperature that is below a sterilization temperature to a final value at the sterilization temperature, so that the flow speed of the air through the sterile filter (23) during the temperature heating phase and final phase is virtually constant, in which the rpm of the fan (21) is raised during the heating phase from the initial value, stored in memory in a control unit, up to the final value on the basis of a predetermined function.

2. The method according to claim 1, in which the predetermined function is a linear function.

3. The method according to claim 2, in which the rpm of the fan (21) is varied, taking a temperature ascertained by a sensor (29) into account.

4. The method according to claim 2, in which the rpm of the fan (21) is varied, taking the requisite heating time into account.

5. The method according to claim 1, in which the rpm of the fan (21) is varied, taking a temperature ascertained by a sensor (29) into account.

6. The method according to claim 1, in which the rpm of the fan (21) is varied, taking the requisite heating time into account.

7. A method for controlling the air speed in a sterilizing tunnel (10) during a heating phase, said sterilizing tunnel (10) having a sterile filter (23) through which air flows, wherein said method comprises: sensing the temperature in the sterilizing tunnel during its heating phase, and in response to the sensed temperature controlling the rpm of a fan (21) from an initial value, when said sterilizing tunnel is at a first temperature that is below a sterilization temperature, to an rpm of a final value when the sterilizing tunnel is at the sterilization temperature, the rpm of the fan being controlled so that the flow speed of the air through the filter during the heating phase is virtually constant and equal to the flow speed of the air when the sterilization tunnel is at its sterilization temperature.

8. The method according to claim 7, in which the rpm of the fan is a linear function when compared to the sensed temperature.

9. The method according to claim 7, in which the rpm of the fan (21) is varied as a direct function of a temperature ascertained by a sensor (29).

10. The method according to claim 7, in which the rpm of the fan (21) is varied as a direct function of the requisite heating time to heat the sterilization tunnel when starting at the sensed temperature.

* * * * *